US009908124B2

(12) United States Patent
Lamy et al.

(10) Patent No.: US 9,908,124 B2
(45) Date of Patent: Mar. 6, 2018

(54) PROTECTION TILES FOR SCROLL CONVEYOR FLIGHTS

(71) Applicant: ANDRITZ S.A.S., Velizy-Villacoublay (FR)

(72) Inventors: Denis Lamy, Chateauroux (FR); Jean-Marc Huyghe, Le Poinconnet (FR)

(73) Assignee: ANDRITZ S.A.S., Velizy-Villacoublay (FR)

( * ) Notice: Subject to any disclaimer, the term of this patent is extended or adjusted under 35 U.S.C. 154(b) by 0 days.

(21) Appl. No.: 14/890,352

(22) PCT Filed: May 15, 2013

(86) PCT No.: PCT/EP2013/001436

§ 371 (c)(1),
(2) Date: Nov. 10, 2015

(87) PCT Pub. No.: WO2014/183772

PCT Pub. Date: Nov. 20, 2014

(65) Prior Publication Data

US 2016/0107172 A1 Apr. 21, 2016

(51) Int. Cl.

| | |
|---|---|
| ***B04B 9/12*** | (2006.01) |
| ***B04B 1/20*** | (2006.01) |
| ***B04B 1/04*** | (2006.01) |

(52) U.S. Cl.
CPC ..... *B04B 9/12* (2013.01); *B04B 1/04* (2013.01); *B04B 1/2008* (2013.01)

(58) Field of Classification Search
CPC ..... B04B 1/2008
USPC ..... 366/318–324; 494/53–54; 198/657–677; 100/145–150
See application file for complete search history.

(56) References Cited

U.S. PATENT DOCUMENTS

| | | | | |
|---|---|---|---|---|
| 4,328,925 A * | 5/1982 | Shapiro | B65G 33/265 | 416/224 |
| 4,416,656 A * | 11/1983 | Shapiro | B65G 33/265 | 494/53 |
| 5,429,581 A * | 7/1995 | Michaud | B04B 1/2008 | 198/677 |
| 6,206,818 B1 * | 3/2001 | Deschamps | B04B 1/2008 | 210/374 |

(Continued)

FOREIGN PATENT DOCUMENTS

| | | |
|---|---|---|
| EP | 0081938 | 11/1982 |
| GB | 2048728 A * | 12/1980 |

(Continued)

*Primary Examiner* — Charles E Cooley
(74) *Attorney, Agent, or Firm* — Alix, Yale & Ristas, LLP

(57) ABSTRACT

A scroll conveyor tile protection or any other material subject to wear with a weldable support and a wear resistant insert, not necessary weldable. The support is fit with a flat surface and shoulder allowing for precise positioning of tile on a scroll flight to be protected. At least one opening, preferably at its center, allows for insertion and assembly of a complementary shaped insert. The unit setting up on the scroll flight and the contact between the flight faces and the unit faces allows for creating a dove tail locking system. Welding of the support permanently insures locking of the system and insert being maintained without being otherwise fixed beyond this mechanical clamping.

18 Claims, 3 Drawing Sheets

(56) References Cited

U.S. PATENT DOCUMENTS

| | | | | |
|---|---|---|---|---|
| 2010/0016140 | A1* | 1/2010 | Dietschreit | B04B 1/2008 494/42 |
| 2016/0107172 | A1* | 4/2016 | Lamy | B04B 1/2008 494/67 |

FOREIGN PATENT DOCUMENTS

| | | | | | |
|---|---|---|---|---|---|
| GB | 2273253 | A | * | 6/1994 | B04B 1/2008 |
| JP | 03127643 | A | * | 5/1991 | |
| JP | 2754055 | B2 | * | 5/1998 | B04B 1/2008 |
| JP | 3443147 | B2 | * | 9/2003 | B04B 1/2008 |

* cited by examiner

PROTECTION TILES FOR SCROLL CONVEYOR FLIGHTS

BACKGROUND

The present invention concerns a protection tile for scroll flight wear protection.

For this type of centrifuge scroll, there is generally a tile protection avoiding flight wear and allowing for durable conveyance when the product to be transported is particularly abrasive.

These protection elements are usually fabricated using carbon tungsten or ceramics, with a coefficient of thermal expansion which can defer significantly from steel which is generally the element of the flight. Assembly of these elements is particularly delicate and several patents proposing solutions concerning rivets, glue or weld, have already been published.

One solution known from U.S. Pat. No. 4,328,925 shows the assembly via a support with grooved dove tail locking system in which an abrasive resistant element is inserted on one side and constitutes a complimentary form. The position is held via glue or deformation of tab or blocking via a plate screwed onto the support. This solution does not insure ortho-radial support of element resistant to abrasion, sufficient enough for friction of product being displaced. These elements can slip and become dislodged.

The solution in European Patent No. 0 081 938 shows an assembly using an abrasive resistant element fixed on the scroll flight using conical rivets. This solution is difficult and costly to implement due to the necessity of drilling the flights.

U.S. Pat. No. 5,429,581 shows an assembly using an abrasive resistant element with male form lodging via an axial slippage into a complimentary housing located on the scroll flight. Even though this solution satisfactory allows for bearing radial, ortho-radial and axial loads, using this method is also difficult and costly to implement due to the requirements of machining for lodgment on the flights. Maintaining tiles in lodging is insured via glue or plates, cone and screws. Multiplication of these maintaining parts can be costly.

In U.S. Pat. No. 6,206,818 an assembly solution is shown using a support with dove tail locking system grooves in which abrasion resistant element is placed present in complimentary form. This element is inserted via side entry slippage or, if space between male and female forms permits, frontal entry. Fixation of the abrasive resistant element is achieved by glue injection into the existing gaps of the support. A hole in the rear of the support and grooves over two parts allow for glue spreading over all empty spaces. This gluing is possible after welding the support on a conveyor flight, which avoids possible alteration of glue due to high temperature welds. Precise positioning of supports before weld is needed to insure final continuity of the wear resistant elements. This requires using special tools as per U.S. Pat. No. 6,230,960 which can cause a long and costly assembling.

DE 3435960 A1 shows a wear tile being one part where an additional ring is mounted in a circumferential opening at the tip of the screw blade. With this opening the screw blade is weakened and thus with high axial forces the tip of the screw blade may break.

JP 2012-551 A1 shows a protecting tile consisting of two parts. However the support is welded to the tip of the screw blade and the wear plate inserted into the support. The wear plate is fixed to the support by means of a cotter, which is inserted from the side. This however can only be done while manufacturing the apparatus. As soon as there are the protection tiles side by side, the cotter cannot be moved.

JP H03-130218 U shows a protection tile where the support is welded to the screw flight. It has a nut where a wear plate is inserted. This wear plate is then fixed by an elastic sealing. However such sealing ring would fall in aggressive (e.g. acid) environment.

U.S. Pat. No. 4,416,656 shows a wear tile consisting of a support and a wear resistant member which is secured with an additional rivet or shank, which is deformed to secure the connection.

DE 3140364 A1 describes a system where the wear resistant member is mounted directly to the screw flight. To keep the members in position pins are mounted at the upper end of the screw flight, which may weaken the flight. Further the wear resistant member must be designed new for each different width and diameter of the flight and thus cannot be used on other machines.

SUMMARY

Considering the inconveniences of the prior art, the present invention defines a new protection tile capable of resisting different mechanical and tribological stresses which will be applied, with a simple, rapid tile assembly along the entire scroll flight.

Thus the invention is mainly characterized in that the support and wear-resistant insert are connected to each other by a mechanical locking system, whereby the support fixation on the flight ensures the locking of the insert by purely mechanical clamping, in that the support has at least one opening where the insert fits in, and preferably the insert has the same number of finger-like extensions to fit in each of the openings of the support. These protection tiles are generally fixed on the flight of a centrifuge scroll or any other mechanical element allowing for product displacement with friction of said product. With such system no additional material as glue or braze is necessary to fix the insert to the support.

An advantageous protection tile has shown that the support has at least one groove-like surface where the insert has a complementary form to fit in.

The invention further concerns a conveyor with a scroll, e.g. screw press, centrifuge, decanter and is characterized by a number of protection tiles mounted onto the scroll at its circumference where the support and wear-resistant insert are connected to each other by a mechanical locking system, whereby the support fixation on the flight insures the locking of the insert by purely mechanical clamping. Due to this purely mechanical clamping, the material used for tile insert can be any type and the invention eliminates any weld, braze, glue issues usually encountered between the support and the wear resistant insert. The use of a surface of the flight to complete a dovetail locking system is particularly advantageous as this simplifies at the same time the assembly and the locking of the tile and avoids a preliminary assembly of the support and the insert. Tile protection is then very quick to implement, with firstly an easy and simple insert fit into the support and secondly a usual support fixation on the flight of the scroll.

Invention defines a tile with a weldable support and a wear-resistant insert. The material used for tile support is generally stainless steel. All other types of steel, stainless or otherwise, may be used if weld adherent. To offer an efficient wear-resistant feature the insert may be made of special steel, tungsten carbide or other carbide or ceramic.

BRIEF DESCRIPTION OF THE DRAWINGS

The invention is now described in accordance with the attached drawings, where.

DETAILED DESCRIPTION

Figure 1:
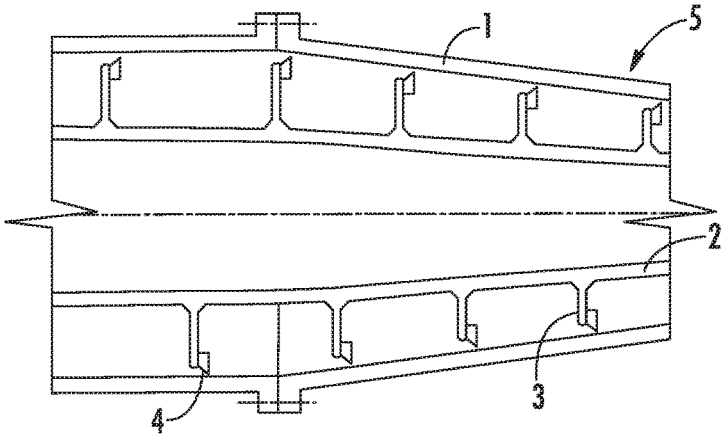
FIG. 1 is a layout of tiles on a scroll conveyor flight according to the invention.

A centrifuge using the invention is illustrated in FIG. 1. The centrifuge 5 is composed of a cylindrical/conical bowl 1 and a conveyor scroll 2 in rotation around the same axis. The bowl 1 and the conveyor scroll 2 are driven in rotation at slightly different speeds generating a relative speed between bowl and scroll called a conveying speed. The scroll is generally comprised of a drum 2 and a flight 3 extending radially between drum 2 and bowl 1. Protection tiles 4 are deposited side by side on the exterior flight edge. The solid/liquid mixture to be separated is introduced to the bowl 1 by means of a feed tube, not shown. The product is driven at the speed of bowl 1 and, under centrifugal force the densest particles of the product are pressed against the interior wall of bowl 1. The scroll conveyor 2, due to its relative rotation movement transports the solid particles called sediment, towards the bowl cone head.

Figure 2:
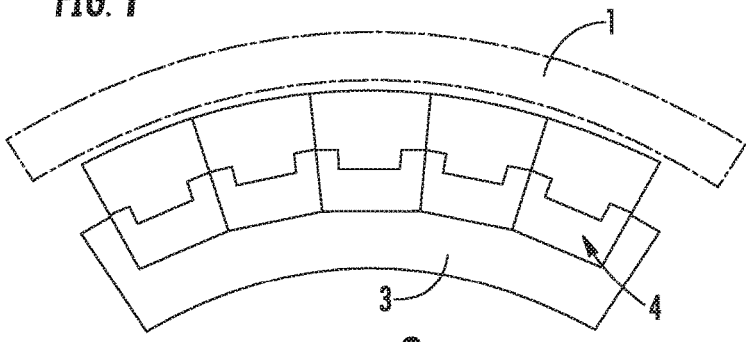
FIG. 2 is a front view of scroll flight with 5 protection tiles according to the invention applied.

As illustrated in FIG. 2, protection tiles 4 fixed side by side on the flight 3 allow for protection of the flight 3 from generally abrasive friction from sediment and add to lifetime of scroll conveyor 2.

Figure 3:
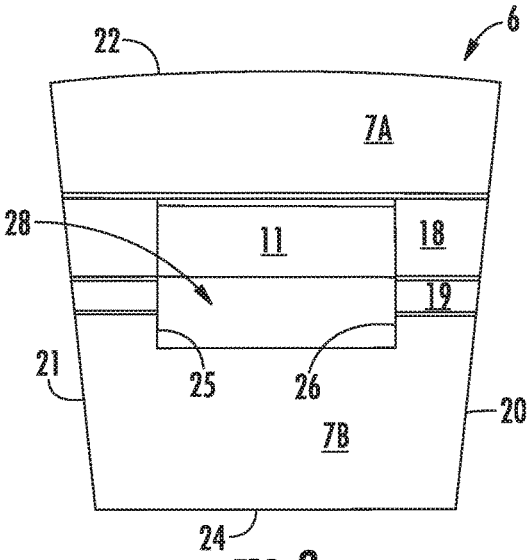
FIGS. 3-5 are front, left and rear views of the tile support according to one embodiment of the invention.
Figure 4:
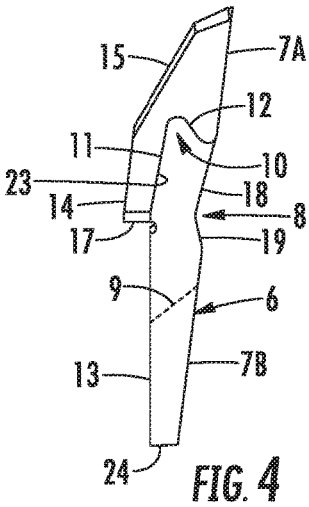
Figure 5:
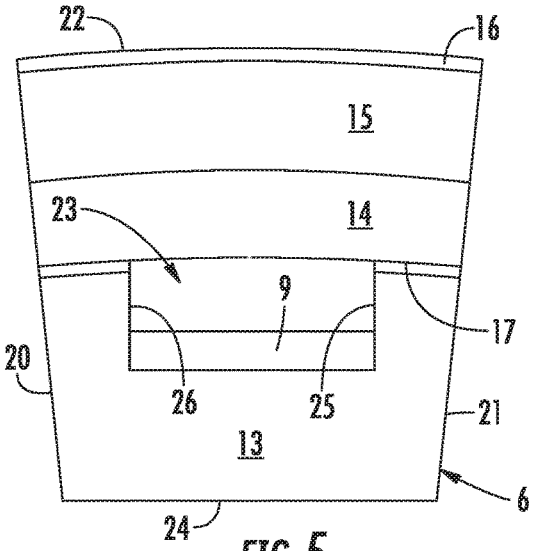

The support 6 according to the invention shown in FIGS. 3-5 has a front face 7A and 7B interrupted by a subsidence 8 defined by surfaces 18 and 19. The rear face of support 6 is comprised of two plane faces 13 and 14 offset and forming a shoulder 17. The lateral surfaces 20 and 21 are plane and form an angle which the tiles can set in, as illustrated in FIG. 2. A profiled opening 23 limited by surfaces 9, 11, 12, 25 and 26 is achieved in this embodiment of the invention in the center of support 6. Surfaces 11 and 12 form a sharp undercut angle and are connected via a radius comprising an upper corner 10. Support 6 is generally obtained by a process of precise molding with the object of obtaining exterior and interior forms to allow for assembly of the insert 41.

Figure 6:
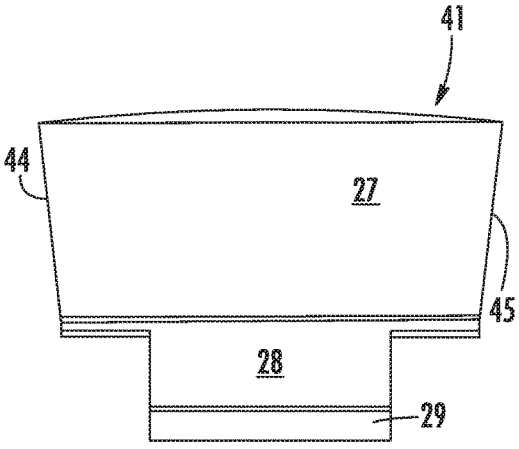
FIGS. 6-8 are front, left and rear views of the insert.
Figure 7:
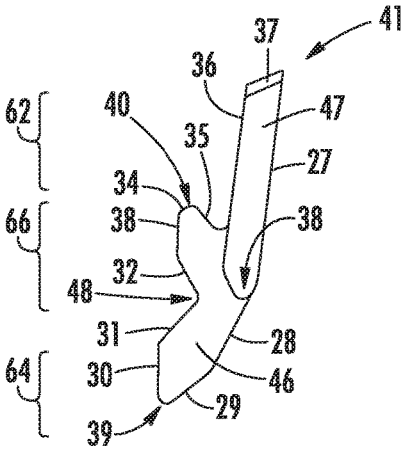
Figure 8:
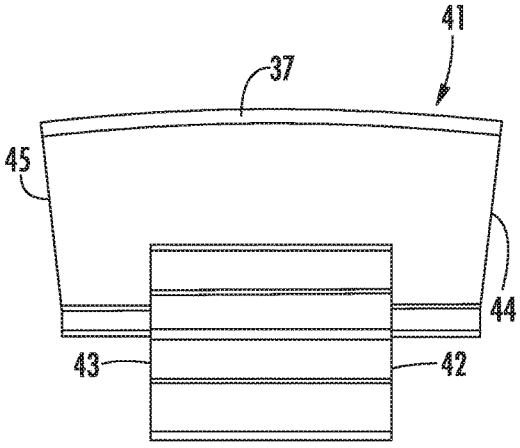

The insert 41 according to the invention shown in FIGS. 6-8 is comprised of a plate-like upper portion 47 and at least one finger 46 completely connected and defining central and lower profiled portions of the insert. Lateral surfaces 44 and 45 are plane and form an angle which the tiles can set in, as illustrated in FIG. 2. Plate 47 is limited by surfaces 27, 36, 37, 44, and 45 and comprises the active part of the protection tile since the friction of the product to be treated is mainly exerted onto the surface 27. The at least one finger 46 has surfaces 33, 34, and 35 in the central portion of the insert and surfaces 28, 29,30, and 31 in the lower portion of the insert. Overall the finger 46 is limited by surfaces 28-35, 42 and 43 and insures the insertion of insert into support 6. The shape of the finger 46 is close to that of the dove tail locking system with upper and lower corners 40 and 39. Surfaces 31 and 32 form opening 48 needed for assembly. Insert 41 is generally obtained by a process of precise molding with the object of obtaining exterior and interior forms to allow for the assembly with the support 6.

Figure 9:
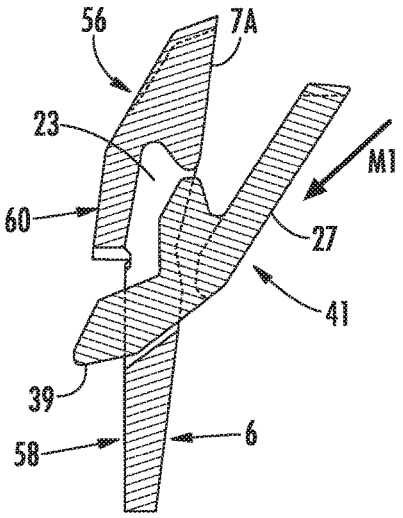
FIGS. 9-10 are section views of a protection tile according to the invention in intermediate assembly position for support and insert.
Figure 10:
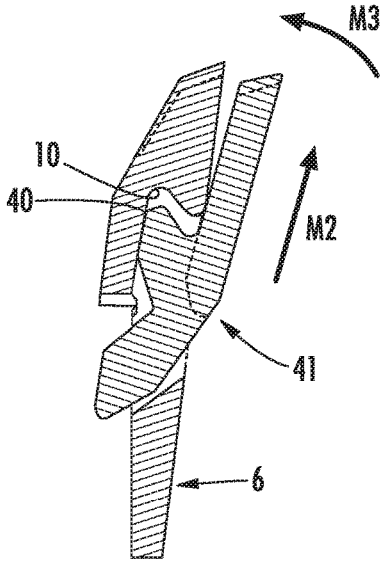
Figure 11:
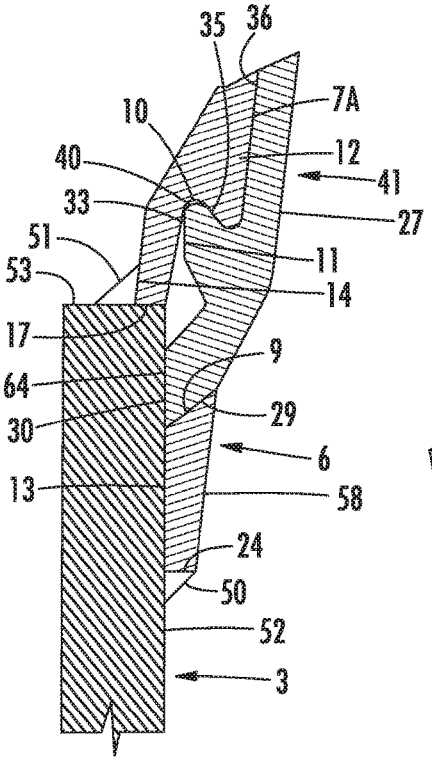
FIG. 11 is a section view for a protection tile according to the invention assembled and welded on a scroll conveyor flight.
Figure 12:
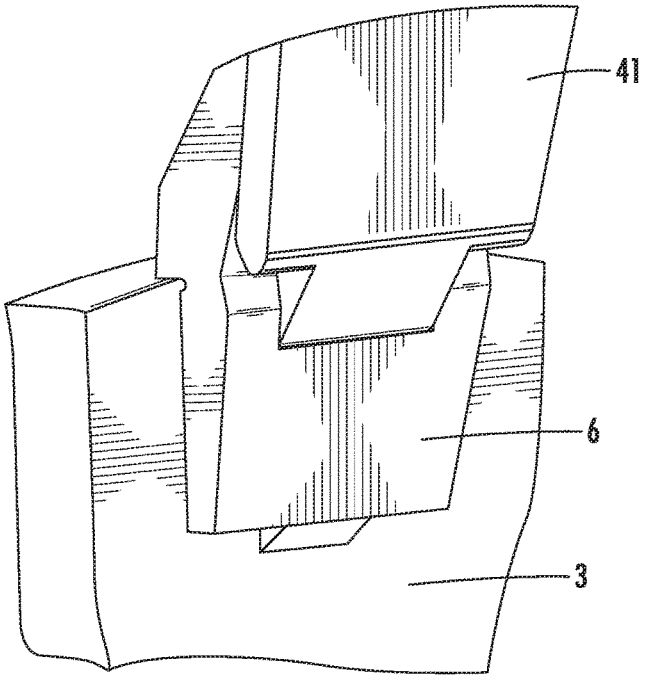
FIG. 12 is a perspective view of a protection tile according to the invention assembled and welded on a scroll conveyor flight.

The assembly of protection tile 4 onto the conveyor scroll 3 is achieved via the following steps. As shown in FIG. 9 and following arrow direction M1, insert 41 is introduced in support 6 by engaging lower corner 39 first in opening 23 of support 6 and by inclining insert 41 so as to form an angle with faces 27 and 7A. As shown in FIGS. 10 and 11, insert 41 is then progressively and simultaneously pivoted and moved following arrows direction M2 and M3 until complete engagement of the upper corner 40 of insert 41 into the complementary lodging 10 of the support 6 is achieved. Then this unit is positioned on flight 3 of scroll 2. Curved shoulder surface 17 and plane surface 13 of support 6 are respectively put in contact with exterior upper surface 53 and the front face 52 of scroll flight 3. The surface 52 then completes the dovetail locking system obtained by surfaces 29, 30, 33 and 35 of insert 41 and surfaces 9, 11 and 12 of support 6. The support is then fixed on the flight 3 generally by welding at angles 51 and 50 formed respectively by surfaces 14 and 53 and surfaces 24 and 52. This insures the assembly clamping and the insert 41 is being maintained without other means of fixation than this mechanical clamping. Dimensions of the two parts are such that the surface 30 of the insert 41 is generally off center towards the rear in relationship to surface 13. Surfaces 29 and 9 form a sharp angle with face 52 of flight 3; the pressure exerted by surface 52 on face 30 tends to push insert 41 towards the top as face 9 slips on face 29. By constraining the assembly in this way, any gap in the dove tail locking system is eliminated and efficient clamping is insured.

Under these conditions, one can see that surfaces 36 and 7A are in contact, insuring adequate resting face for insert 41 on support 6 and allowing the protection tile to support axial load exerted by the product on the friction surface 27.

The width of finger 46 is slightly less than the width of the opening 23. Existing gaps between surfaces 43 and 26 and surfaces 42 and 25 are limited but sufficient to allow for assembly described above. Friction of the product to be transported, on surface 27 generates ortho-radial forces on insert 41. Contact between surfaces 43 and 26 or between surfaces 42 and 25, depending on scroll rotation direction, allows insert 41 to support these forces.

Finally, the dove tail locking system and especially the contact between male corner 40 of the insert 41 and female corner 10 of the support 6, allows the insert 41 to support centrifugation forces.

It can thus be appreciated that the wear-resistant tile for attachment to a scroll flight of a rotor, comprises a support part 6 attachable to the scroll flight, having a front face 7A, 7B and a back face 13, 14, and a profiled opening 23 passing entirely through the front and back faces. An insert 41 has one, lower profiled portion 46 fit within and retained only mechanically to the support part by mating of the profiles through the opening of the support part, and another portion 27 defining a primary wear-resistant surface. As shown in FIG. 9, the support part has upper 56, lower 58, and central 60 portions, with the central portion defining the profiled opening 23 passing entirely through the front and back faces. As shown in FIG. 7, the back face of the insert has upper 62, lower 64, and central 66 portions, with the central portion including a profiled surface that fits within and is mechanically retained to the support part by mating of the profiles through the opening 23 of the support part.

Preferably, as shown in FIG. 11, when the insert fits within and is retained mechanically to the support part, the lower portion 58 of the support part at the back face 13 and the lower portion 64 of the insert at the back face 30 are coplanar. An upper edge surface or ledge 9 of the lower portion of the support is angled upwardly from back face to front face, and the lower portion of the insert defines a bottom surface 29 that is angled upwardly from back face to front face. When the insert fits within and is retained only mechanically to the support part, such that the support part at the back face and the lower portion of the insert at the back face are coplanar, the angled upper edge 9 of the lower portion of the support part bears against the angled bottom surface 29 of the insert.

The downwardly facing undercut at 10, 11, and 12 in a region between the back face and the front face of the support part, mates with the upwardly oriented projection 40 at the back of the central portion 66 of the insert, which has a profile that is complementary to the undercut of the support part. When the insert fits within and is retained mechanically to the support part, such that the support part at the back face and the lower portion of the insert at the back face are coplanar, the projection on the insert interlocks with the undercut on the support part.

During operation, the product to be transported could possibly pass through spaces between support 6 and insert 41 without causing harm to tile resistance. If this intrusion of product cannot be tolerated, an appropriate resin can be used to fill the gaps.

In another embodiment than the one shown in FIGS. 3-8, the support 6 is fixed on the flight 3 by means of glue, screws or rivets instead of weld.

In another embodiment than the one shown in FIGS. 3-8, the flight surface used to complete the dove tail locking system may be the outer surface 53 or the rear surface 54.

In another embodiment than the one shown in FIGS. 3-8, the opening 23 of support 6 and the finger 46 of insert 41 may be duplicated and differently positioned, for instance on both side of the parts instead of in their centers. The support may have two symmetrical openings equally spaced from its median plan which the insert comprising similar symmetrical fingers may lodge into. The openings and fingers form complementary nature suffices to ensure assembling and clamping of the system according to the above described principle.

The invention is not limited to the embodiments in the drawings but as explained above in the range of the following claims.

The invention claimed is:

1. A wear-resistant tile for attachment to a scroll flight of a rotor, comprising:

a support part attachable to the scroll flight, having a front face and a back face, and a profiled opening passing entirely through the front and back faces; and an insert having one, profiled portion fit within and retained mechanically to the support part by mating of said profiles through the opening of the support part, and an other portion defining a primary wear-resistant surface, wherein the support part has upper and lower regions with respective front and back surfaces;

the upper region of the support part has a profiled front surface defining an upper portion of the opening, including an undercut, and a profiled back surface;

the lower region defines a lower, ledge portion of the opening;

the one portion of the insert has a back upper surface that fits within the upper portion of the opening and includes a projecting surface that fits within the undercut of the support part, and a lower portion including a bottom surface that mates with the ledge portion of the lower portion of the opening;

whereby when said bottom surface is mated with said ledge portion, said undercut mechanically retains the projecting surface within the support part.

2. The wear-resistant tile according to claim 1, wherein said one portion is an integral, finger-like extension from said other portion.

3. The wear-resistant tile according to claim 1, wherein the other portion is a plate with a front face defining said primary wear-resistant surface, said face having opposed top and bottom spanning a height, and opposed sides spanning a width; and said one portion projects downwardly from the plate with a width less than the width of the front face.

4. The wear-resistant tile according to claim 1, wherein the support part has a profiled front surface defining the opening, including an undercut, and a profiled back surface; and the one portion of the insert has a back surface that fits within the opening and includes a projecting surface that fits within the undercut of the support part.

5. The wear-resistant tile according to claim 1, wherein the ledge inclines upwardly from the back surface to the front surface of the lower region; and the bottom surface inclines downwardly from the front to the back surfaces of said one portion the insert;

whereby when said bottom surface is mated with said ledge, said undercut and said ledge mechanically retain the insert at both the upper and lower portions of the opening.

6. The wear-resistant tile according to claim 1, wherein the support part has at least one groove-like surface and the insert has a complementary shape that can be fit in the groove-like surface.

7. The wear-resistant tile of claim 1, wherein a plurality of said wear-resistant tiles are provided at the circumferential edge of a scroll flight of a rotor, with each respective support part fixed to the flight and each insert retained only mechanically to a support part.

8. A conveying device having a rotating scroll flight with circumferentially attached wear-resistant tiles, wherein each tile comprises a support part fixed to the scroll flight and defining a profiled opening; and an insert having one portion fits within and is retained only mechanically to the support part through the opening of the support part and another portion defining a primary wear-resistant surface;

wherein the support part has a front face and a back face, with the profiled opening passing entirely through the front and back faces; and the one portion of the insert is profiled to fit within and be retained only mechanically to the support part by mating of said profiles through the opening of the support part, wherein the support part has upper and lower regions attached to the flight, with respective front and back surfaces;

the back surface of the upper region is offset from the back surface of the lower region;

the offset is defined by a shoulder aligned within the opening of the support part;

the upper region of the support part has a profiled front surface defining an upper portion of the opening, including an undercut, and a profiled back surface;

the lower region defines a lower, ledge portion of the opening;

the one portion of the insert has a back upper surface that fits within the upper portion of the opening and includes a projecting surface that fits within the undercut of the support part, and a lower portion including a bottom surface that mates with the ledge portion of the lower portion of the opening; and said shoulder is attached to the circumferential edge of the flight and the bottom of the one portion of the insert is flush with the front of the flight such that said bottom surface is mated with said ledge portion and said undercut mechanically retains the projecting surface within the support part.

9. The conveying device according to claim 8, wherein the support part is welded to the flight.

10. The conveying device according to claim 8, wherein the support part has a profiled front surface defining the opening, including an undercut, and a profiled back surface; the one portion of the insert has a back surface that fits within the opening and includes a projecting surface that fits within the undercut of the support part.

11. The conveying device according to claim 8, wherein the ledge portion inclines upwardly from the back surface to the front surface of the lower region; and the bottom surface inclines downwardly from the front to the back surfaces of said one portion the insert;

whereby when said bottom surface is mated with said ledge portion, said undercut and said ledge mechanically retain the insert at both the upper and lower portions of the opening.

12. The conveying device according to claim 8, wherein the support part has at least one groove-like surface and the insert has a complementary rise that fits in the groove-like surface.

13. A conveying device having a rotating scroll flight with circumferentially attached wear-resistant tiles, wherein each tile comprises a support part fixed to the scroll flight and defining a profiled opening; and an insert having one portion fits within and is retained only mechanically to the support part through the opening of the support part and another portion defining a primary wear-resistant surface;

wherein the support part has a front face and a back face, with the profiled opening passing entirely through the front and back faces; and the one portion of the insert is profiled to fit within and be retained only mechanically to the support part by mating of said profiles through the opening of the support part, wherein said one portion of the insert is locked mechanically to the support part through a dovetail connection with the support part and a mechanical retention of the other portion against the flight by the support part.

14. A wear-resistant tile for attachment to a scroll flight of a rotor, comprising:

a support part attachable to the scroll flight, having a front face, a back face, and upper, lower, and central portions, with the central portion defining a profiled opening passing entirely through the front and back faces; and an insert having a front face defining a primary wear-resistant surface, a back face, and upper, lower, and central portions, with the central portion including a profiled surface at the back face that fits within and is mechanically retained to the support part by mating of said profiles through the opening of the support part, wherein when the insert fits within and is retained mechanically to the support part, the lower portion of the support part at the back face and the lower portion of the insert at the back face are coplanar.

15. The wear-resistant tile according to claim 14, wherein an upper edge of the lower portion of the support part defines a portion of the profiled surface of the opening in the support part that is angled upwardly from back face to front face;

the lower portion of the insert defines a bottom surface that is angled upwardly from back face to front face; and when the insert fits within and is retained mechanically to the support part, such that the support part at the back face and the lower portion of the insert at the back face are coplanar, the angled upper edge of the lower portion of the support part bears against the angled bottom surface of the insert.

16. The wear-resistant tile according to claim 14, wherein a region of the upper portion of the support part defines a downward facing undercut between the back face to front face;

the profiled surface at the back of the central portion of the insert defines a projection that is complementary to the undercut of the support part; and when the insert fits within the support part, such that the support part at the back face and the lower portion of the insert at the back face are coplanar, the projection on the insert interlocks with the undercut on the support part to retain the insert within the support part only mechanically.

17. A conveying device having a rotating scroll flight with circumferentially attached wear-resistant tiles, comprising:

a support part attached to the scroll flight, having a front face, a back face, and upper, lower, and central portions, with the central portion defining a profiled opening passing entirely through the front and back faces;

an insert having a front face defining a primary wear-resistant surface, a back face, and upper, lower, and central portions, with the central portion including a profiled surface at the back face that is mechanically mated with the profile of the opening on the support part;

wherein the upper back portion of the insert is in coplanar contact with the upper front portion of the support part; and wherein the lower back portion of the support part and the lower back portion of the insert are in coplanar contact with the scroll flight;

whereby the support part is retained only mechanically to the scroll flight.

18. The conveying device according to claim 17, wherein an upper edge of the lower portion of the support part defines a portion of the profiled surface of the opening in the support part that is angled upwardly from back face to front face;

the lower portion of the insert defines a bottom surface that is angled upwardly from back face to front face; and the angled upper edge of the lower portion of the support part bears against the angled bottom surface of the insert.

* * * * *